United States Patent [19]

Ogg

[11] Patent Number: 4,676,184

[45] **Date of Patent: * Jun. 30, 1987**

[54] FLEXIBLE SHANK ANCHORS

[75] Inventor: Robert D. Ogg, Kentfield, Calif.

[73] Assignee: Alpha Ocean Systems, Inc., Kentfield, Calif.

[ * ] Notice: The portion of the term of this patent subsequent to Dec. 24, 2002 has been disclaimed.

[21] Appl. No.: 774,921

[22] Filed: Sep. 11, 1985

[51] Int. Cl.[4] ..... B63B 21/44

[52] U.S. Cl. ..... 114/304; 114/294

[58] Field of Search ..... 114/293-310

[56] References Cited

U.S. PATENT DOCUMENTS

| | | | |
|---|---|---|---|
| 2,576,390 | 11/1951 | Dansforth | 114/309 |
| 2,669,963 | 2/1954 | Christie | 114/298 |
| 2,674,968 | 4/1954 | Dansforth | 114/309 |
| 3,120,830 | 2/1964 | Northrop et al. | 114/309 |
| 3,716,012 | 2/1973 | Wright | 114/304 |
| 4,073,256 | 2/1978 | Rossini | 114/306 |
| 4,134,355 | 1/1979 | Carruthers | 114/304 X |
| 4,469,042 | 9/1984 | Ogg | 114/304 |
| 4,559,893 | 12/1985 | Ogg | 114/304 |

*Primary Examiner*—Joseph F. Peters, Jr.
*Assistant Examiner*—Edwin L. Swinehart

[57] ABSTRACT

Anchor structures including a flexible shank having improved fluke, crown and shank attachment and crownless designs which enhance bottom penetration and burying capability.

11 Claims, 21 Drawing Figures

FLEXIBLE SHANK ANCHORS

BACKGROUND OF THE INVENTION

An anchor generally comprises several elements including ground engaging means usually in the form of one or more planar or curvilinear surfaces usually termed the fluke or flukes. Various fluke shapes are shown in patents to Danforth U.S. Pat. No. 2,249,546; Danforth U.S. Pat. No. 2,674,968; Bruce U.S. Pat. Nos. 2,711,150, 2,840,029 and 3,024,756, Towne U.S. Pat. Nos. 3,777,695 and 4,134,356; van den Haak U.S. Pat. Nos. 3,015,299 and 3,783,815; Taylor U.S. Pat. Nos. 3,902,446, 3,964,421 and 4,089,288; and Klaren U.S. Pat. Nos. 1,974,933 and 4,024,090.

In association with the fluke surfaces, means are provided to facilitate and maintain the proper engagement of the fluke surfaces with the bottom. Such means are usually termed the crown, which initially lifts the after-end of the anchor to force the fluke surfaces into bottom engagement.

A shank extends forwardly from the crown in advance of the fluke surfaces for attachment to an engaged cable or chain. Shanks have usually been in the form of a heavy, solid rectilinear bar. Various authors have pointed out that, particularly in a harder bottom such as sand, penetration of an anchor into bottom often is limited by the shank which slides over the bottom resisting penetration.

It has long been recognized that deep penetration into the bottom is a prime factor in determining the efficiency of an anchor. If the anchor does not penetrate, then the anchor structure merely slides across the bottom.

To provide stability, one or more elements extending laterally from the fluke or flukes are provided to stabilize the entire anchor structure so that it does not rotate when subject to the pulling action applied to the shank by an attached rode. Such an element is frequently referred to as the stock.

With the advent of flexible shanks for anchor structures, as described in U.S. Pat. No. 4,469,042 issued Sept. 4, 1984 to Robert D. Ogg and pending application Ser. No. 642,338 entitled NOVEL SHANK FOR AN ANCHOR STRUCTURE, modifications have been possible to various anchor elements such as the flukes, crown and even crownless anchor designs so as to permit better bottom penetration and burying capability.

SUMMARY OF THE INVENTION

The present invention relates to anchor structures having flexible shanks that enable improved fluke, shank attachment and crown designs which in combination with the flexible shank enhance bottom penetration and burying capability of the anchor structure.

Another feature of the invention is a crownless anchor having a flexible shank to enhance bottom penetration.

An object of the invention also is the application of flexible shanks to pivoted and to non-pivoted fluke anchors to enhance their penetration and burying capability.

Other objects of the invention will become apparent upon consideration of the specifically described embodiment and the accompanying drawings.

DESCRIPTION OF THE PREFERRED EMBODIMENTS

Figure 19:
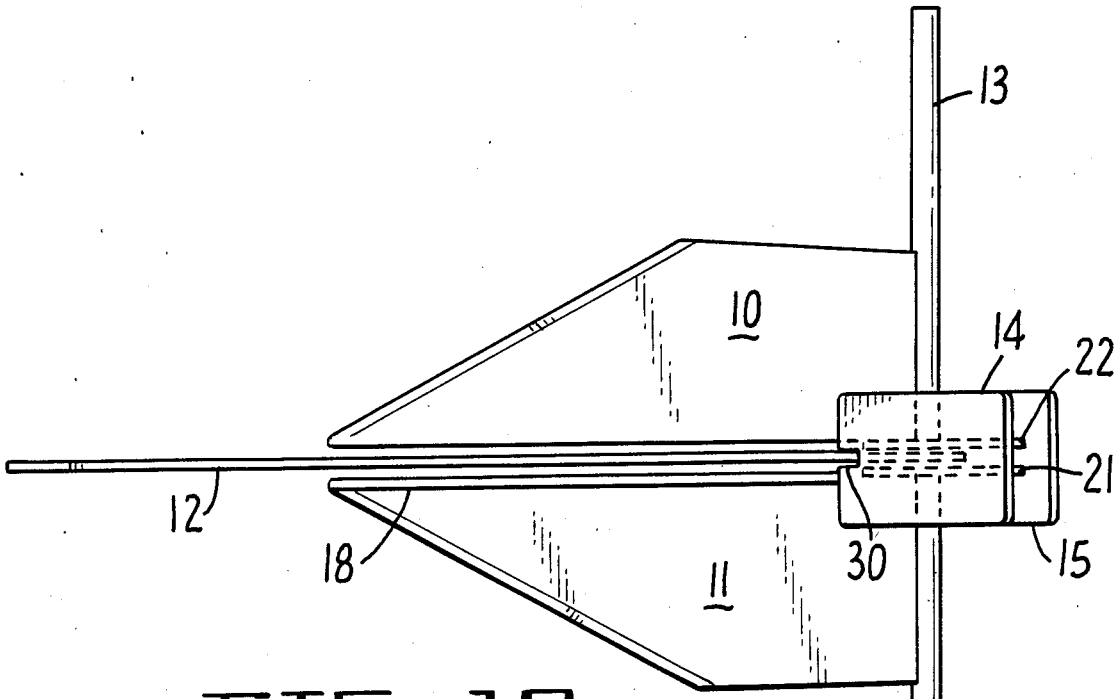
FIG. 19 is an improved crown-type anchor having parallel crown plates and parallel edged flukes.
Figure 20:
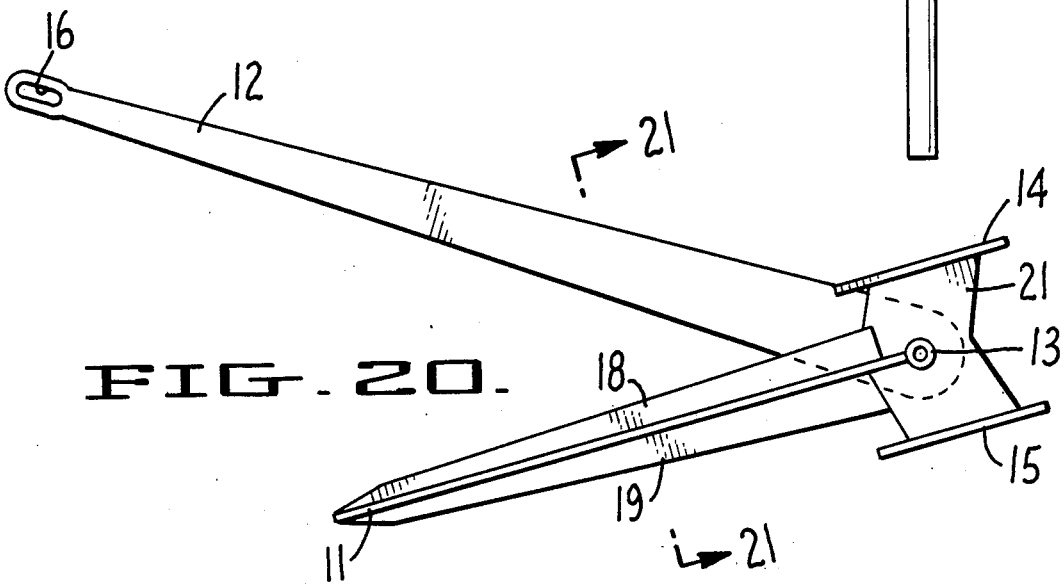
FIG. 20 is a side elevational view of the anchor shown in FIG. 19.
Figure 21:
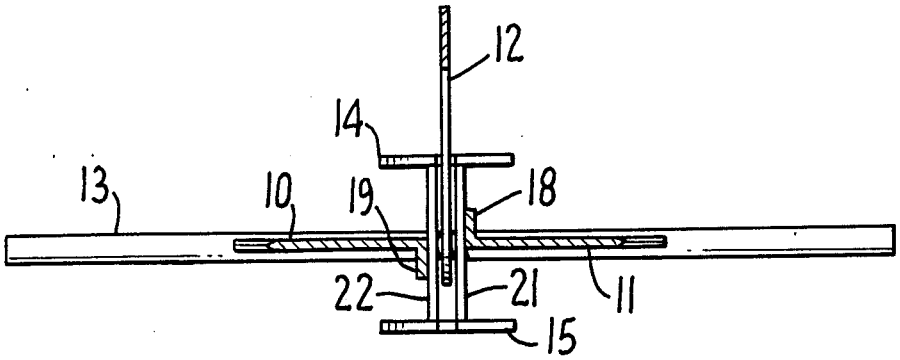
FIG. 21 is a partial sectional view of the anchor taken along line 21—21 of FIG. 20.

FIGS. 1–3, 10–11 and 15–18 illustrate a variety of flexible shank anchors of the crownless type and FIGS. 19–21 illustrate an improved crown type anchor having a flexible shank. FIGS. 5–9 and 12–14 illustrate shank swing stop and shank mounting variations for flexible shank anchors.

Figure 1:
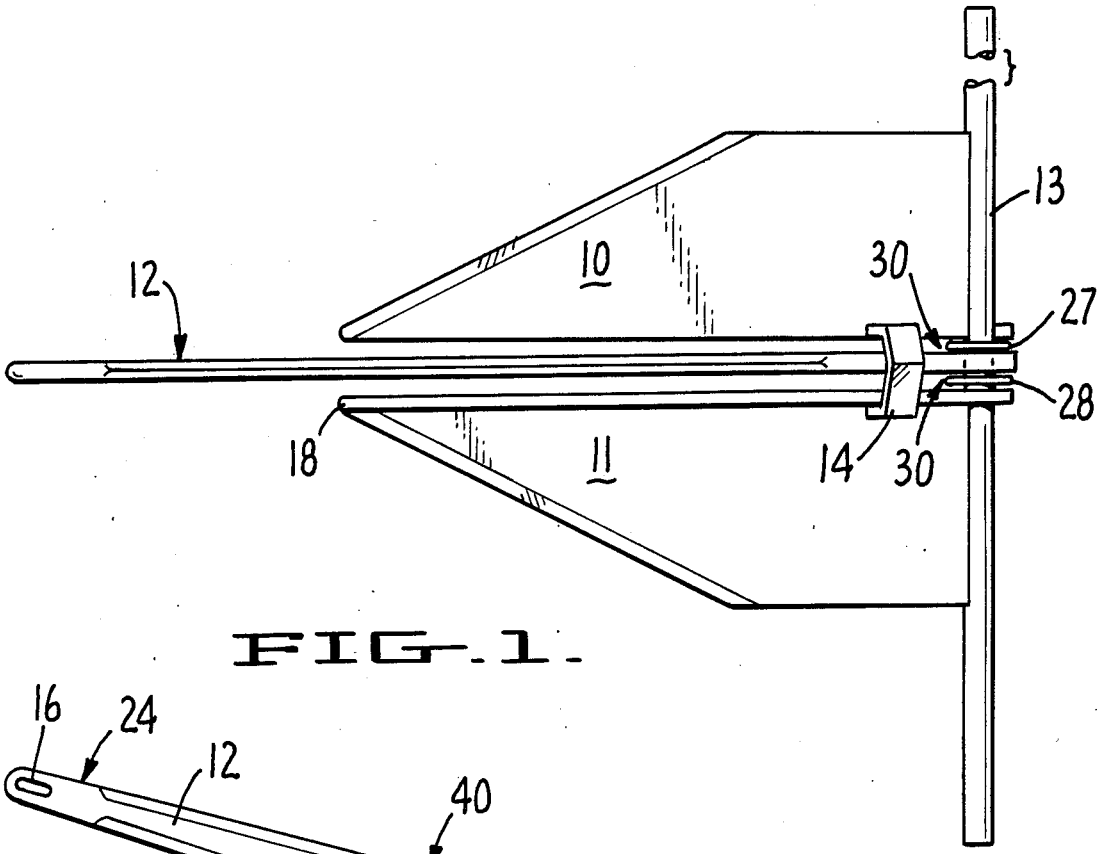
FIG. 1 illustrates a crownless anchor design having a flexible shank and improved horizontally pivoted flukes.
Figure 2:
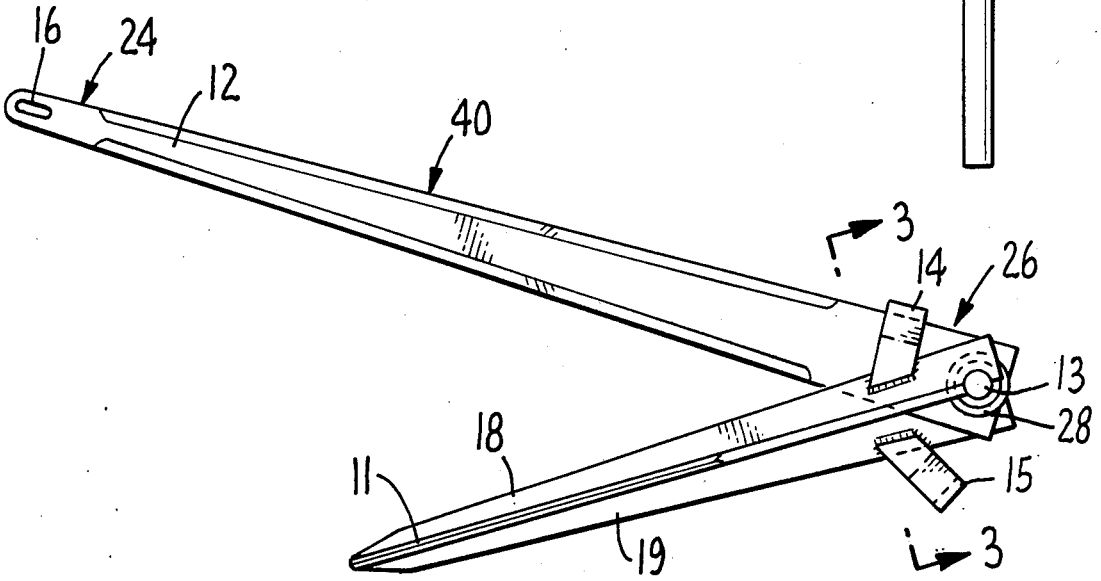
FIG. 2 is a side elevational view of the anchor of FIG. 1.
Figure 3:
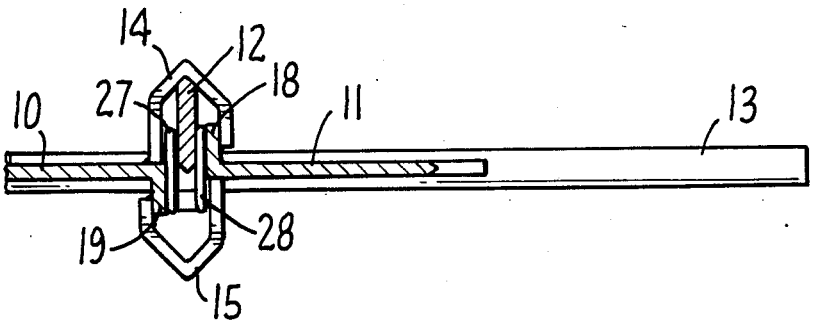
FIG. 3 is a sectional view of the anchor taken along line 3—3 of FIG. 2 showing the flexible shank attachment means.

The anchor of FIGS. 1–3 is of the crownless type having a pair of flukes 10 and 11 attached to a stock 13 upon which a flexible shank 12 pivots horizontally between the flukes when in bottom engaging position. A single reinforcing flange or rib 18 extends upwardly from the surface of fluke 11 and a single reinforcing rib 19 extends downwardly from the surface of fluke 10 along the inner fluke edges which are oriented generally in parallelism with the axis of shank 12. A first generally U-shaped shank swing stop 14 is welded to the upwardly extending rib 18 on fluke 11 and to the top surface of fluke 10. A second shank swing stop 15 of similar configuration is welded to the depending rib 19 on fluke 10 and to the bottom surface of fluke 11 as is more clearly illustrated in the sectional view, FIG. 3. The shank swing stops 14,15 restrict the swing of the shank relative to the flukes 10,11 generally within the range of 30°–60° as described in U.S. Pat. No. 4,469,042.

The shank 12 is of the flexible kind described in U.S. Pat. No. 4,469,042 issued Sept. 4, 1984 to Robert D. Ogg for SHANK FOR AN ANCHOR STRUCTURE. It has a tip end 24, a base end 26 and an intermediate portion 40 as indicated on FIG. 2. The tip end carries a rode attachment eye 16. The base end 26 pivots loosely on the stock 13 between washers 27,28 which define the deflection stop 30 shown on FIG. 4 where the flexible shank commences its bend. The washers 27,28 locate the shank centrally between the flukes 10,11 and acting in combination with reinforcing ribs 18,19 define stop 30 for commencement of bending.

Figure 4:
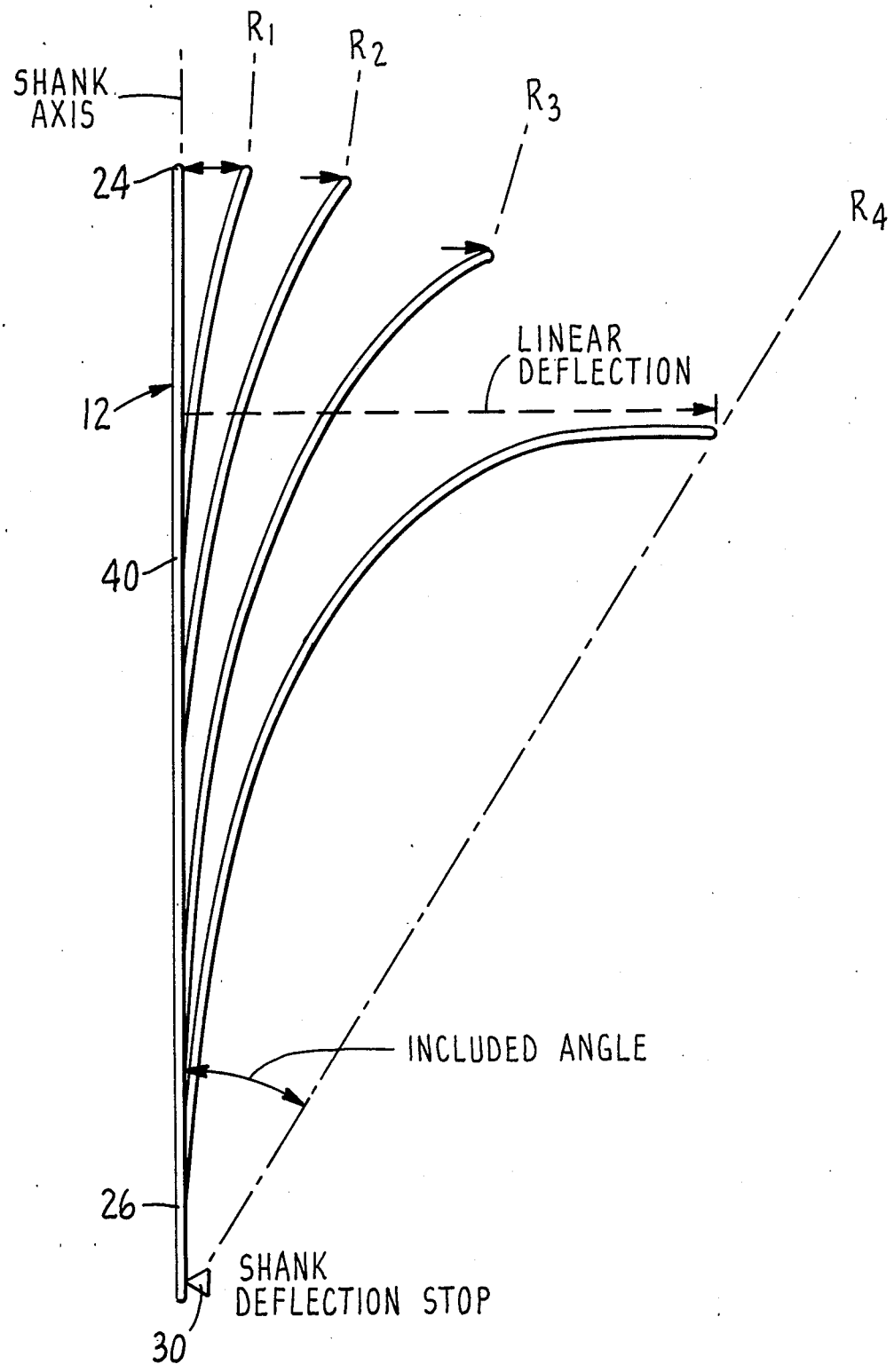
FIG. 4 is a diagram illustrating the flexible shank design parameters.

Also, as described in U.S. Pat. No. 4,469,042, the criterion of importance in design of the shank are the "included angle" and the "linear deflection" as shown on FIG. 4. The "included angle" is that angle between (1) a line drawn through the tip of the shank and that point on the longitudinal axis of the shank at which curvature of the shank commences, i.e. the shank deflection stop 30, and (2) the longitudinal axis of the shank when the shank is at rest. This angle is shown in FIG. 4 for the deflected shank position designated $R_4$. The "linear deflection" is the distance measured along a line normal to the shank between (1) the shank tip and (2) the longitudinal axis of the shank at rest. This dimension is also shown in FIG. 4 for shank position $R_4$.

Deflection can be expressed as a function of the "shank length" where "shank length" is defined as the distance between the shank deflection stop 30 and the center of eye 16 to which the rode is attached. Thus, with the shank deflected to an "included angle" of 45° to the longitudinal axis of the shank when the shank is at rest, its tip end 24 is spaced from the longitudinal axis of the shank by a "linear deflection" which is about 60% of the shank length without any adverse effect such as breaking, or permanent set or deformation.

The non-flexible shanks used heretofore were incapable of any deflection beyond about an "included angle" of 5° without permanent deformation or actual breakage of the shank. The flexible shanks described in U.S. Pat. No. 4,469,042 flex to an "included angle" in the range of 25°–80° without causing permanent deformation of the shank.

Figure 5:
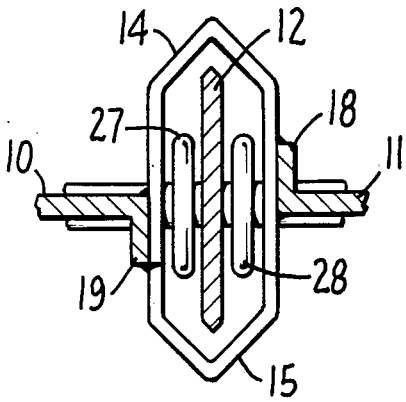
FIG. 5 illustrates an alternative shank swing stop and flexible shank attachment in a crownless anchor.
Figure 6:
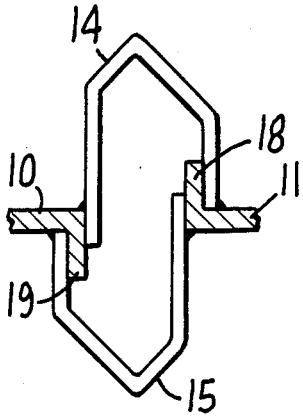
FIG. 6 illustrates another form of shank swing stop in a crownless anchor.
Figure 7:
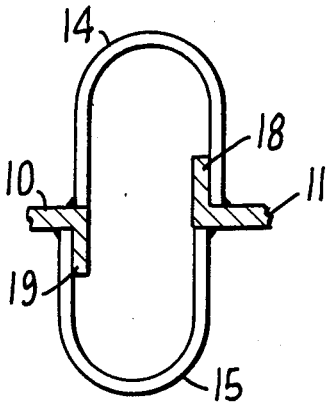
FIG. 7 also illustrates a shank swing stop for a crownless anchor.
Figure 8:
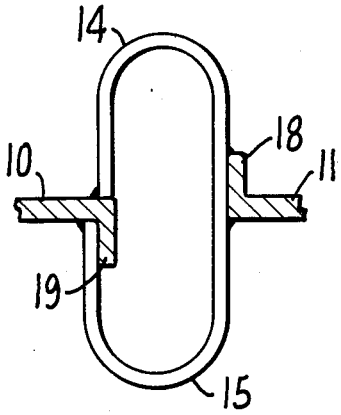
FIG. 8 illustrates still another shank swing stop for a crownless anchor.
Figure 9:
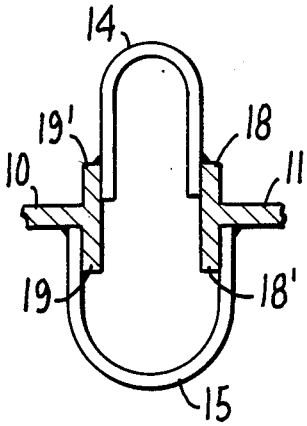
FIG. 9 illustrates one other shank swing stop for a crownless anchor.

A variety of shank swing stop designs and flexible shank attachment arrangements are shown in FIGS. 5–14. In FIG. 5 the shank swing stops 14,15 may comprise a continuous steel strip welded to the inside of flanges 18,19 of the anchor flukes. A stronger configuration than that shown in FIG. 3 is illustrated in FIG. 6 with the shank swing stops welded to the flukes at the inside edge and the base of ribs 18,19, respectively. The shank swing stops also may be of generally oval design shown in FIG. 7, welded as in FIG. 3; of semi-continuous oval design shown in FIG. 8; or of the dual U-shaped design shown in FIG. 9 for flukes having reinforcing ribs 18,18' and 19,19' extending outwardly from both the fluke surfaces.

Figure 10:
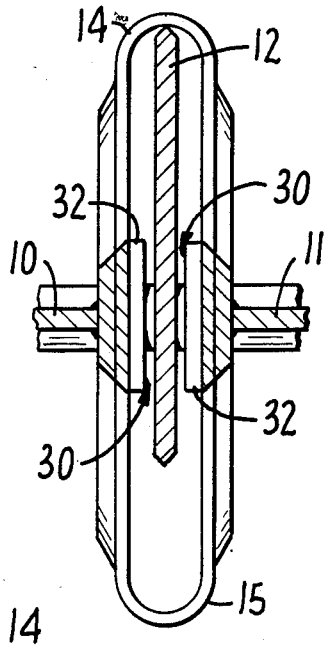
FIG. 10 illustrates in section the shank attachment for the crownless anchor as shown in FIG. 11.
Figure 11:
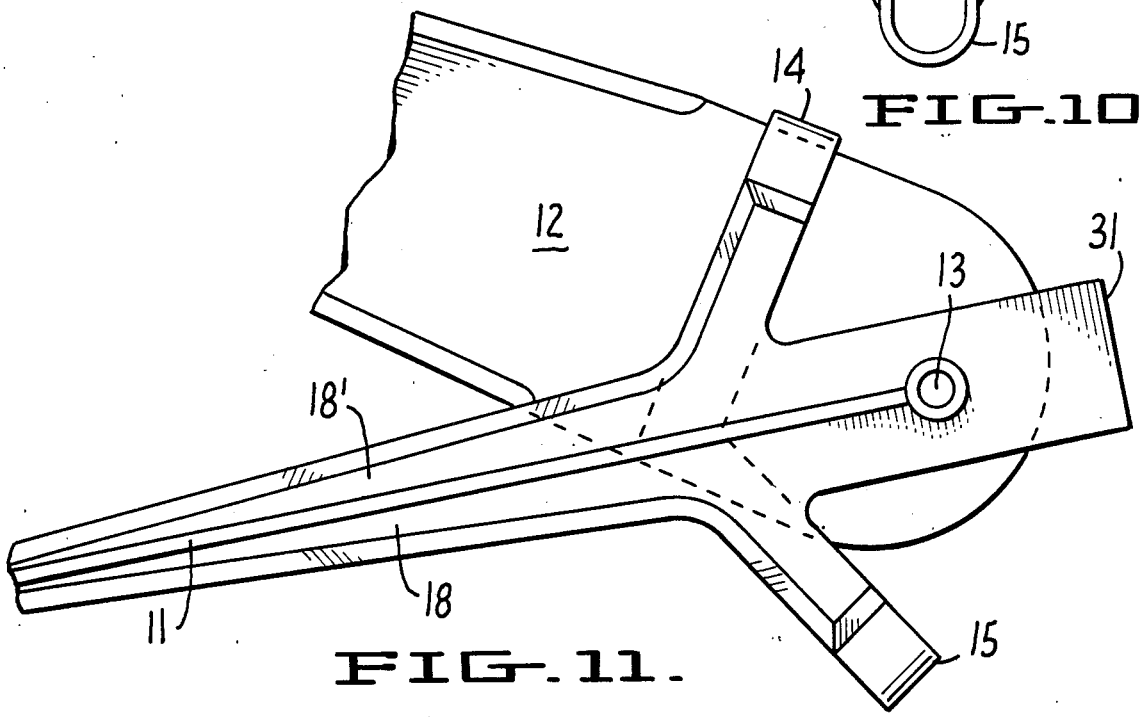
FIG. 11 illustrates a further crownless anchor and flexible shank attachment.

The shank swing stops 14,15 also may be of the design illustrated in the crownless anchor of FIGS. 10 and 11 using insert means such as welded plate inserts 32 instead of loose washers to center the shank 12 and define the shank deflection stop as at 30.

Figure 12:
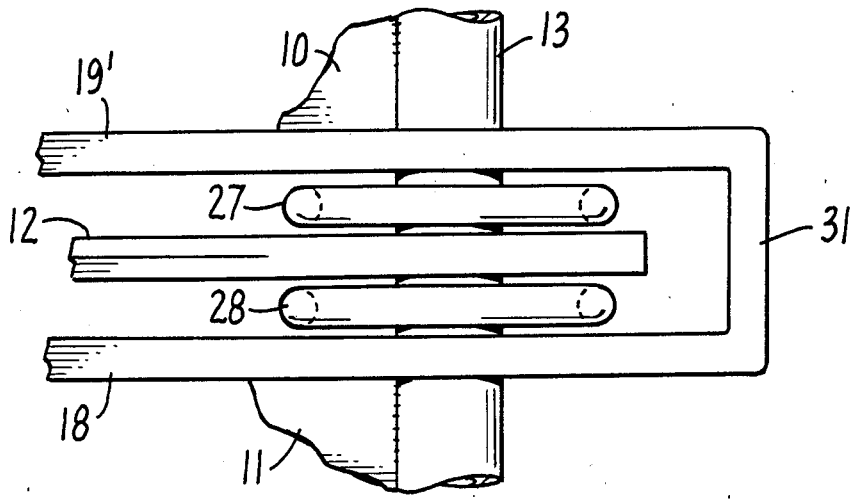
FIG. 12 illustrates a shank attachment useful in crownless and crown-type anchors.
Figure 13:
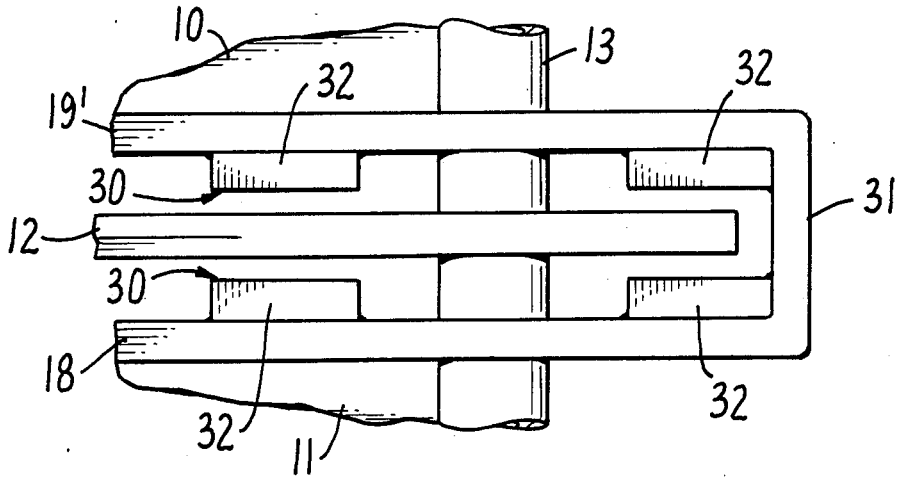
FIG. 13 illustrates a flexible shank attachment also useful for crownless and crown-type anchors.
Figure 14:
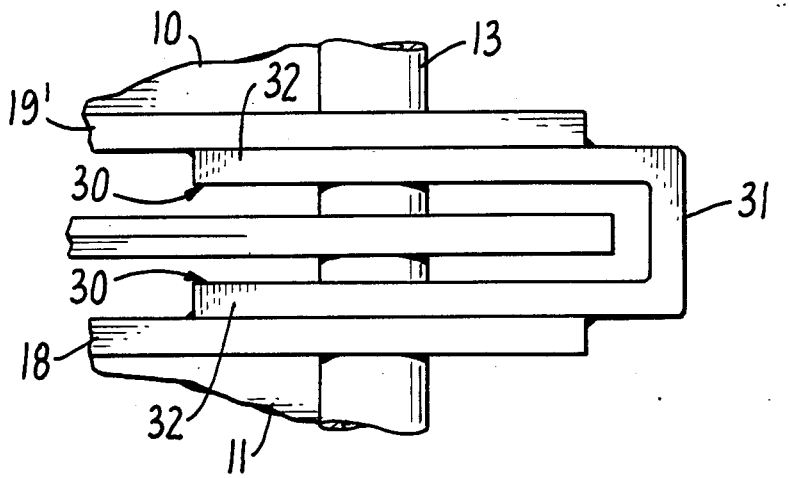
FIG. 14 illustrates a further flexible shank attachment for crownless and crown-type anchors.

FIGS. 12–14 illustrate other means for attachment of flexible shanks in crown-type or crownless anchors with horizontally pivoted flukes. In FIGS. 12–14 the fluke flanges 18,19' are connected together with a back tie bar 31 as, for example, in the crownless anchor of FIG. 11. Insert means such as separate weldment inserts 32 upon the fluke ribs, themselves, in this design may also be used to define the deflection shank stop 30 and restrict shank deflection in the region surrounding the stock as an alternate to washers 27,28.

Figure 15:
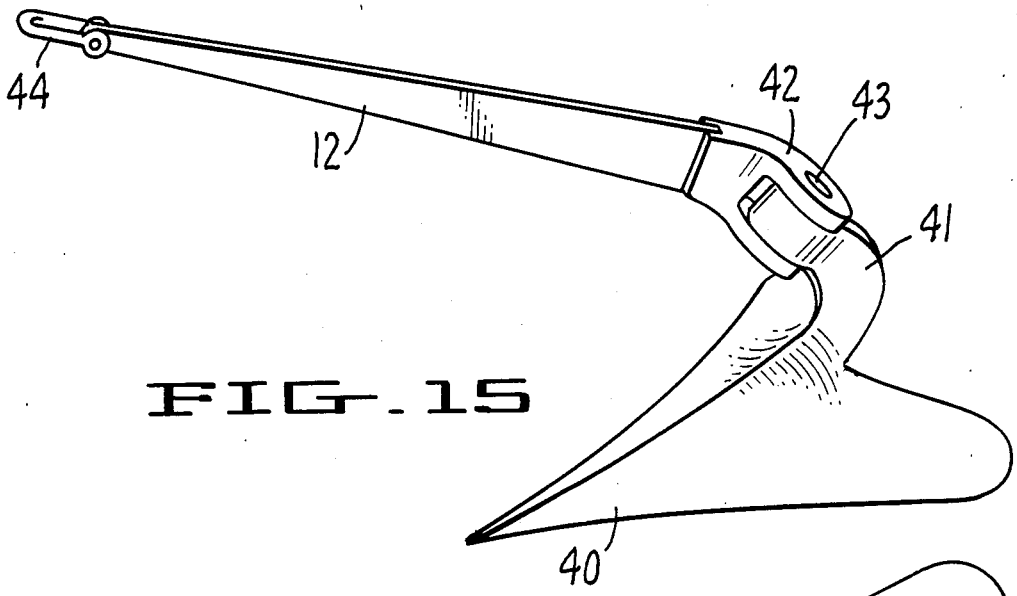
FIG. 15 is a flexible shank anchor of the plow type having its shank pivotable about a generally vertical axis.
Figure 16:
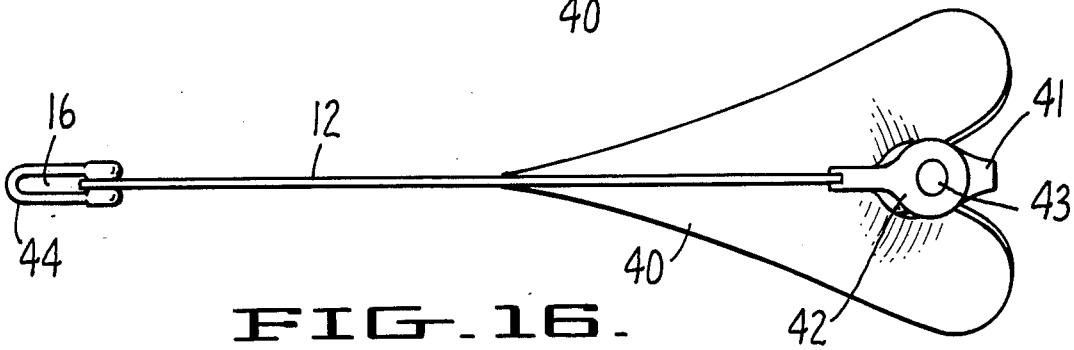
FIG. 16 is a top view of the anchor shown in FIG. 15.
Figure 17:
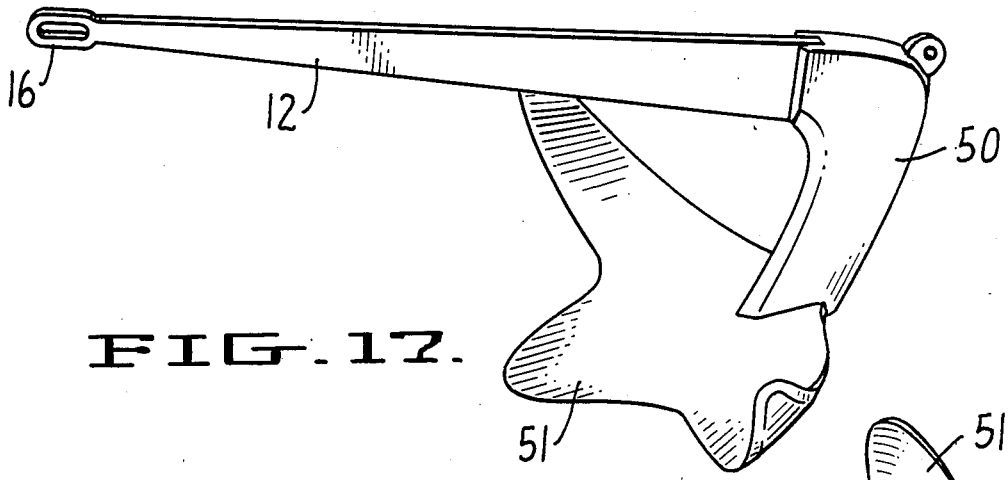
FIG. 17 is a Bruce anchor having a flexible shank.
Figure 18:
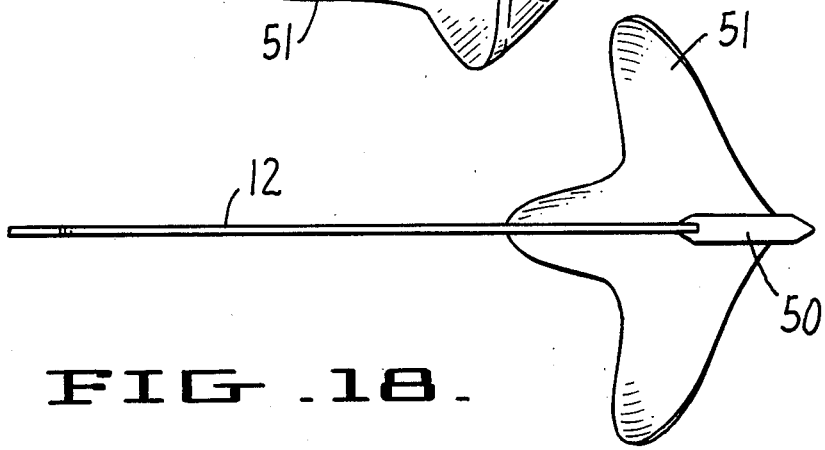
FIG. 18 is a top view of the Bruce anchor shown in FIG. 17.

FIGS. 15 and 16 illustrate a flexible shank applied to a plow-type anchor with a generally plow shaped single fluke 40 attached to an upstanding shank stub 41 to which a flexible shank 12 of the type described in U.S. Pat. No. 4,469,042 is attached by clevis 42 at one end pivoted upon the shank stub 41 on pin 43. Clevis 44 pinned to the free end of the shank 12 carries rode-connecting eye 16.

The flexible shank 12 also can be utilized by fastening it to the vertical shank stub in a Bruce anchor having a clam shell shaped fluke 51 as is more particularly described in U.S. Pat. Nos. 2,711,150 2,840,029 and 3,024,756. In both of the crownless anchors illustrated in FIGS. 15–18, the flexible shanks 12 are fastened into milled grooves in the clevis 42 and vertical shank stub 50, respectively. The flexible shank enhances the penetration and burying capability of these crownless anchors, too.

FIGS. 19–21 illustrate a crown-type anchor using a flexible shank wherein the crown plates 14,15 that define the shank deflection stop 30 are parallel rather than canted toward one another at their forward ends as normally provided in this type of anchor so as to initially lift the after-end of the anchor to force the fluke surfaces into bottom engagement. The parallel crown plates 14,15 are mounted upon closely spaced side plates 21,22 welded respectively to the fluke reinforcing ribs 18,19 on either side of the shank 12 as shown in FIG. 21. The side plates center the pivotable shank upon stock 13 between the flukes 10,11. The parallel crown plates provide less resistance to anchor penetration into the bottom and thereby enhance burying capability as compared to canted crown plates shown, for example, in U.S. Pat. No. 4,469,042.

Similarly, the use of flukes having their inner edges and ribs 18,19 parallel to the shank axis as shown in FIGS. 1 and 19 enhances penetration and burying capability by encountering less bottom resistance than the divergent inner fluke edges and ribs shown in the crown-type anchor illustrated in U.S. Pat. No. 4,469,042.

Both of these modifications in crown-type anchors are enabled by use of a flexible shank which, itself, inherently improves penetration because of its thinness. Thus parallel fluke edges and ribs 18,19 can be used to enhance penetration. Parallel crown plates can be employed, too, with a flexible shank without loss in initial anchor penetration.

Various other anchor structures may be modified in the manner described herein. The invention is defined in the following claims.

I claim:

1. In a crownless anchor having at least one bottom penetrating fluke the improvement comprising a thin, flexible and resilient shank having a tip end and a base end for attachment in said anchor for cooperation with said fluke to enhance penetration of said bottom, the shank when at rest having a horizontal plane and a vertical plane normal to the horizontal plane, the shank being inherently rigid in said vertical plane and capable of flexing in said horizontal plane throughout its length with a tip angle in the range of 25° to 80° without causing permanent deformation of the shank.

2. The crownless anchor of claim 1 having a pair of flukes pivotable about a horizontal axis one on each side of and adjacent to said shank.

3. The crownless anchor of claim 1 having a single fluke with a bottom penetrating surface, a stub shank affixed to said fluke at an acute angle to said surface, said flexible shank being pivoted upon said stub shank and also defining an acute angle with said surface.

4. The crownless anchor of claim 1 having a single fluke with a bottom penetrating surface, a stub shank affixed to said fluke, said flexible shank rigidly affixed to said stub shank and defining an acute angle with said surface.

5. A crownless anchor having a thin, flexible and resilient shank having a tip end and a base end for attachment in said anchor;

the shank when at rest having a horizontal plane and a vertical plane normal to the horizontal plane, the shank being inherently rigid in said vertical plane and capable of flexing in said horizontal plane throughout its length with a tip angle in the range of 25° to 80° without causing permanent deformation of the shank; and a pair of flukes pivotally attached to said shank about a horizontal axis one on each side of an adjacent to said shank wherein the flukes have inner edges parallel to the axis of said shank.

6. The crownless anchor of claim 5 wherein the flukes carry a reinforcing rib on their inner edge and further comprising washer means adajcent each rib to center said shank and define a shank deflection stop.

7. The crownless anchor of claim 5 wherein the flukes carry a reinforcing rib on their inner edge and further comprising insert means mounted upon each rib to center said shank and define a shank deflection stop.

8. In an anchor having a pair of flukes mounted upon a stock, a pair of crown plates pivotable with said flukes each disposed on opposite sides of said stock, a thin, flexible and resilient shank having a tip end and a base end independently pivoted on said stock relative to and between said flukes, the shank when at rest having a horizontal plane and a vertical plane normal to the horizontal plane, the shank being inherently rigid in said vertical plane and capable of flexing in said horizontal plane throughout its length with a tip angle in the range of 25° to 80° without causing permanent deformation of the shank, the improvement comprising straight inner edges on said flukes arranged in parallelism to the axis of said shank when at rest.

9. The anchor of claim 8 wherein the crown plates are parallel to one another.

10. The anchor of claim 9 further comprising a relief cut in each crown plate in alignment with said shank to provide a shank deflection stop for said shank at the ground engaging position of said flukes.

11. The anchor of claim 8 further comprising reinforcing ribs on the inner edges of said flukes and insert means mounted upon each rib to center said shank and define a shank deflection stop.

* * * * *